US007898180B2

(12) United States Patent
Kumada et al.

(10) Patent No.: US 7,898,180 B2
(45) Date of Patent: Mar. 1, 2011

(54) HIGH PRESSURE DISCHARGE LAMP

(75) Inventors: Toyohiko Kumada, Himeji (JP); Nobuhiro Nagamachi, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 216 days.

(21) Appl. No.: 12/327,460

(22) Filed: Dec. 3, 2008

(65) Prior Publication Data

US 2010/0176707 A1 Jul. 15, 2010

(30) Foreign Application Priority Data

Dec. 19, 2007 (JP) ..... 2007-326957

(51) Int. Cl.
*H01J 17/18* (2006.01)

(52) U.S. Cl. ..... 313/623; 313/626

(58) Field of Classification Search ..... 313/623–626
See application file for complete search history.

(56) References Cited

U.S. PATENT DOCUMENTS 6,271,628 B1 8/2001 Sugitani et al.
6,448,712 B2 * 9/2002 Honda et al. ..... 313/631
6,774,566 B2 * 8/2004 Honda et al. ..... 313/634

* cited by examiner

*Primary Examiner* — Vip Patel
(74) *Attorney, Agent, or Firm* — Roberts Mlotkowski Safran & Cole, P.C.; David S. Safran

(57) ABSTRACT

A high pressure discharge lamp having a hermetically sealed portion on opposite sides of an arc tube made of quartz glass and in which a pair of opposed electrodes is located is improved so that electrode rod warping is prevented even when the lamp is repeatedly lit and unlit. Electrode rods extending from the electrodes pass through a center hole in a respective quartz glass body which is positioned and fastened onto each the electrode rods with an infrared reflection membrane composed of a heat-resistant metal being provided on the inner surface of the center hole of the quartz glass body separating the electrode rod from the quartz glass body. The quartz glass body is integrated with the quartz glass forming the hermetically sealed portion and is positioned against a step formed at the boundary between large and small diameter portions of the electrode rod.

8 Claims, 4 Drawing Sheets

| | Structure Near the Electrode Rods | 100 Times | 200 Times | 1000 Times |
|---|---|---|---|---|
| Embodiment 1 | Glass body with holes + with inner surface Mo membrane | O | O | O |
| Comparative Example 1 | Conventional seal (with initial cracks) | X | – | – |
| Comparative Example 2 | Conventional seal (without initial cracks) | O | X | – |
| Comparative Example 3 | Glass body with holes + without inner surface Mo membrane | O | X | – |

HIGH PRESSURE DISCHARGE LAMP

BACKGROUND OF THE INVENTION

1. Field of Invention

The present invention relates to a high pressure discharge lamp, and more particularly, it relates to a high pressure discharge lamp which is used as a light source for liquid crystal projectors or DLP projector apparatus.

2. Description of Related Art

Typically, a lamp unit wherein in a high pressure discharge lamp having high mercury vapor pressure, like that in Japanese Patent Application Laid-open Number H11-297268 and corresponding U.S. Pat. No. 6,271,628, is attached to a concave reflecting mirror is used as a light source for liquid-crystal projector or DLP projector apparatuses. This is because light in the visible wavelength region can be obtained at a high output level by increasing the vapor pressure of the mercury.

Recently, alternating current high pressure discharge lamps have become the mainstream for high pressure discharge lamps used in projectors, but lamps such as these have a problem in which the electrode temperature is higher than is the case with direct current high pressure discharge lamps. Alternating current high pressure discharge lamps have a higher electrode temperature because each electrode in each pair must be able to be used as a negative pole which releases thermions, thereby making it impossible to significantly reduce the size of each electrode as with the electrodes used in direct current high pressure discharge lamps. As a result, it becomes impossible to secure sufficient heat capacity to withstand operation as a positive pole.

Also, because there has been demand for more compact light sources and demand for high pressure discharge lamp designs that can withstand high power and high operating pressure as higher light intensity is required, heat capacity of the electrode head has increased and the diameter of the electrode rod in the hermetically sealed portion has decreased. However, problems occur in which a weight imbalance between the electrode heads and electrode rod diameters is thereby caused, the electrode moment at the quartz glass opening increases, equal concentric contact between the electrode rods and quartz glass inner wall is lost, and stress between tungsten and the quartz glass increases during thermal contraction. Also, educational applications are increasing in the projector market, therefore leading to increased usage aspects wherein the light source flashes more frequently and thereby requiring electrodes with higher flashing tolerance.

When such a high pressure discharge lamp for alternating current is used by repeatedly having the lamp lit at the rated power then unlit, the electrode shafts of the high pressure discharge lamp bends. As a result, a problem occurs in which the discharge arc position shifts away from the optical axis of the concave mirror and the optical output from the lamp unit decreases.

FIG. 5 is a partial frontal view showing the structure of a high pressure discharge lamp relating to the prior art wherein warping occurred in the electrode shafts. Warping of the electrode shafts herein refers to a state in which, a shown in FIG. 5, a pair of electrodes 101, 102, which are placed inside a high pressure discharge lamp 100 with the center of electrode heads 105, 106 near openings 103, 104 of the quartz glass is exposed inside the discharge space, is warped so as to separate in the longitudinal direction of electrode rods 109, 110 which are embedded in hermetically sealed portions 107, 108. The warping of the electrode shafts, in other words, the separation distance of the centers of the electrode heads 105, 106 relative to the longitudinal axis of the electrode rods 107, 108 has reached 1.5 mm or more in high pressure discharge lamps having a distance from the center of the electrode heads 105, 106 to the openings 103, 104 of the quartz glass of 5 mm. Such a degree of warping is significant enough to affect the product lifetime.

Upon inspection of the warping of the electrode shafts, it was found that, in the conventional sealing method, the quartz glass and electrode rods were always brought into contact, then sealed in order to fuse the electrode rods to the glass of the surrounding hermetically sealed tubes through contraction in a negative pressure environment. A large number of cracks were found to have occurred in locations which were contact sealed. Upon closer examination, by repeatedly having the lamp lit and unlit and thereby repeating causing thermal expansion of the electrodes, it was found that the portions wherein the cracks occurred become the fulcrum points at which the electrodes began to bend toward the direction where there were cracks or toward the direction where there were no cracks.

Even if no cracks have occurred in locations that were contact sealed to the electrode rods before the lamp was turned on, as the lamp is repeatedly lit and unlit, over time, the electrode rods and the glass will be welded together, causing cracks to form. It was found that, with these cracks as the fulcrum points, the electrode rods began to warp either in the direction cracks had occurred or in the direction where there were no cracks. In other words, the electrodes expanded and contracted repeatedly when the lamp was repeatedly turned on. It is conceivable that, because the quartz glass and the electrode rods are welded together on the side having cracks, the side with cracks became the fulcrum point at which the side that was not welded lengthens, causing the electrode rods to warp towards the side with cracks. It is also conceivable that if the welds were not released by the cracks when the lamp was turned on, then the electrode rods were re-welded due to thermal expansion and contraction when the lamp was unlit, and therefore, warped in the opposite direction to the cracks.

SUMMARY OF THE INVENTION

In view of the foregoing, it is an object of the present invention to provide a high pressure discharge lamp which can control warping of the electrode rods therein even when the lamp is repeatedly lit and unlit, thereby extending the lifetime of the lamp.

The present invention employs the following means to solve the above-mentioned problems.

A first means is a high pressure discharge lamp having a sealed portion on both sides of an arc tube composed of quartz glass, wherein a pair of opposed electrodes is located within the arc tube; the electrode rods supporting the electrodes passing through a center hole in a quartz glass body wherein a gap is provided around the center hole, the quartz glass body is positioned and fastened on to the electrode rods, an infrared reflection membrane composed from heat-resistant metal is provided on the inner surface of the center hole in the quartz glass body, and the quartz glass body is integrated with the quartz glass forming the hermetically sealed portion.

The second means is the high pressure discharge lamp according to first means in which the electrode rods comprise a large-diameter portion continuing to the electrodes and a small-diameter portion continuing to the large-diameter portion, the small-diameter portion passes through the center hole in the quartz glass body, the quartz glass body is positioned by a step portion formed at the boundary between the large-diameter portion and the small-diameter portion, and the edge face of the arc tube in the quartz glass body has a concave shape which is symmetrical along the central axis of the quartz glass body while the diameter of the edge face gradually increases toward the outside thereof.

The third means is the high pressure discharge lamp according to first means or second means in which the infrared reflection membrane is composed from molybdenum.

The fourth means is the high pressure discharge lamp according to either first means or third means in which 0.16 $mg/mm^3$ of mercury, a halogen, and a noble gas, is enclosed in the arc tube and lit up by alternating current.

According to the present invention, because a structure is used wherein the electrode rods and the metal membrane on the inner face of the center hole in the quartz glass body are separated, there is no need to be concerned with welding occurring between the electrode rods and the quartz glass and it is possible to prevent warping failures of the electrode rods.

DETAILED DESCRIPTION OF THE INVENTION

An embodiment of the present invention is explained below referring to FIGS. 1-4.

Figure 1:
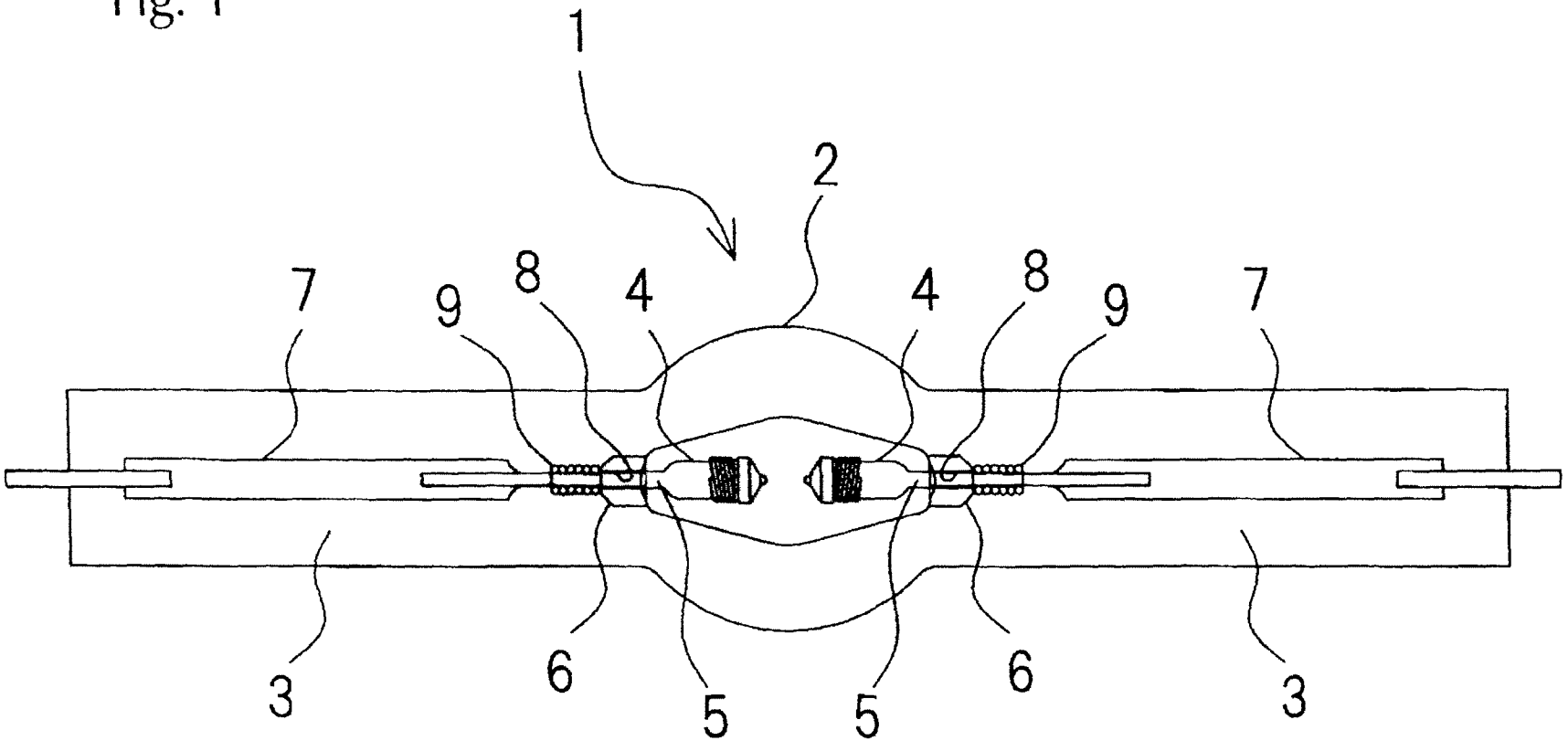
FIG. 1 is a planar view of the structure of the high pressure discharge lamp according to the present invention.

As shown in FIG. 1, the high pressure discharge lamp 1 is an alternating current ignition type high pressure discharge lamp comprising hermetically sealed portions 3 on both sides of an arc tube 2 made of quartz glass. A pair of opposed electrodes 4 are inside the arc tube along with at least 0.16 $mg/mm^3$ or more of mercury, noble gas, and halogen. The electrodes of the pair of electrodes 4 are nearly identical in shape.

Figure 2:
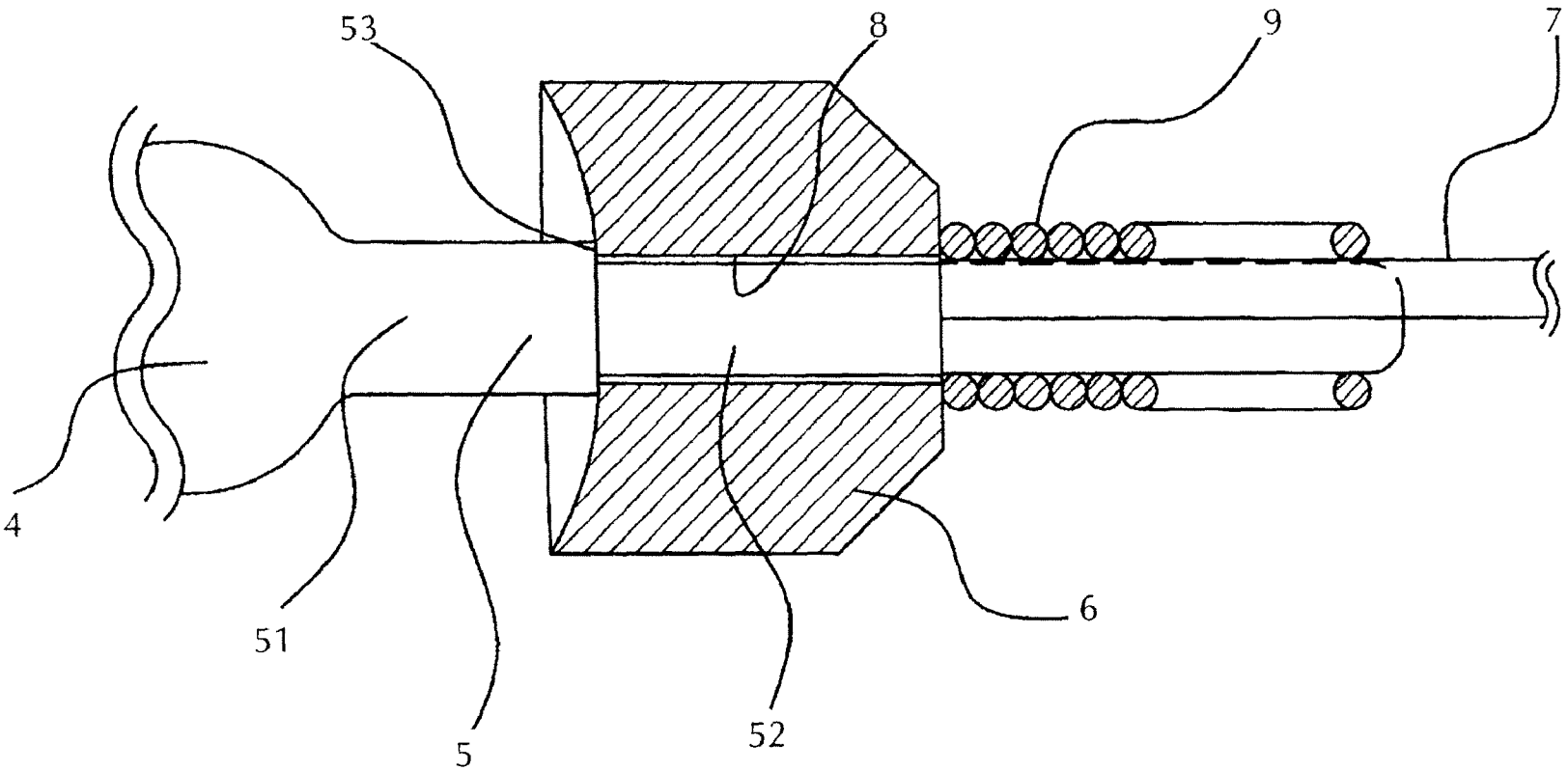
FIG. 2 is an enlarged frontal view of the electrode mount in the high pressure discharge lamp shown in FIG. 1.
Figure 3A:
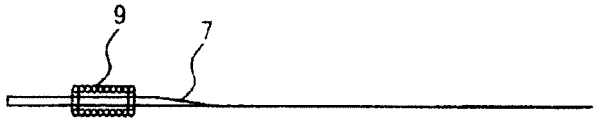
FIG. 3 is an example of a process for manufacturing the electrode mount according to the present invention.
Figure 3B:
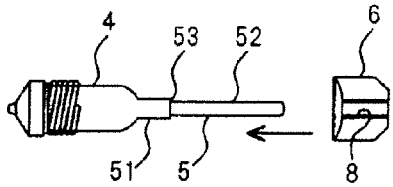
Figure 3C:
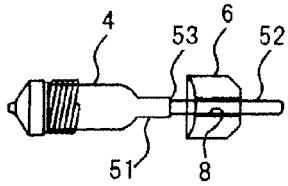
Figure 3D:
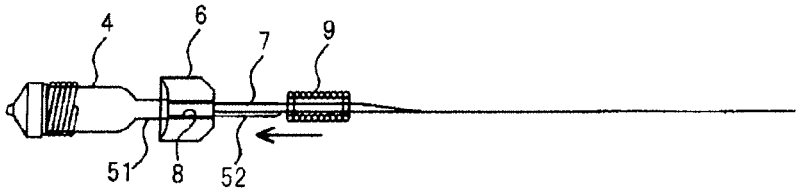
Figure 3E:
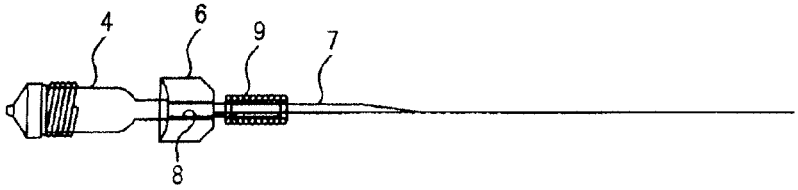
Figure 3F:
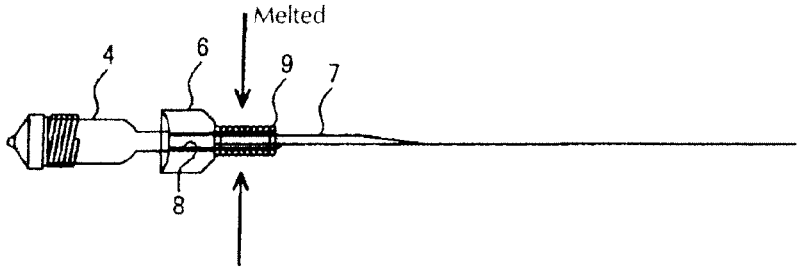

FIG. 2 is an enlarged frontal view of an electrode mount in the high pressure discharge lamp 1 shown in FIG. 1.

The term "electrode mount" here refers to a structure comprising the electrode rod 5 having an electrode 4 on the tip thereof, the quartz glass body 6 which the electrode rod 5 passes through, the coil 9 and the metal foil 7 made of, for example, tungsten and through which the electrode rod 5 passes to outside of the quartz glass body 6, all of which are welded at the metal foil 7. The electrode rod 5 which continues from the electrode 4 in the electrode mount comprises an electrode rod large-diameter portion 51, an electrode rod small-diameter portion 52, and an electrode rod step portion 53 which is formed at the boundary between the electrode large-diameter portion 51 and the electrode small-diameter portion 52. The electrode small-diameter portion 52 passes through a central hole in the quartz glass body 6 with a predetermined gap, then the quartz glass body 6 is positioned and fastened at the electrode rod step portion 53. An infrared reflecting membrane 8 composed from a heat-resistant metal is provided on the inner surface of the central hole in the quartz glass body 6. The quartz glass body 6 is ultimately joined with the quartz glass which forms the sealed portion 3.

Molybdenum (Mo) is preferred as the material for the infrared reflecting membrane 8 of a heat-resistant metal, but tungsten (W) can also be used. When mercury is included in the arc tube 2, platinum (Pt) cannot be used because an amalgam would be formed with mercury, thereby consuming the mercury. Also, when a halogen is included inside the arc tube 2, rhenium (Re) or tantalum (Ta) cannot be used because a halide would be created, causing the infrared reflecting membrane 8 to peel off.

An embodiment of an electrode mount relating to the present invention is explained herein referring to FIG. 2.

The electrode mount is structured so that a Mo membrane which is the infrared reflecting membrane 8 covers the inside surface of the central hole in the quartz glass body 6, and so that the electrode rod small-diameter portion 52 does not come into direct contact with the surface bounding the central hole of the quartz glass body 6. The Mo membrane is formed by either sputtering or vapor deposition. The large-diameter portion 51 of the electrode rod 5 has a diameter of 0.6 mm, for example, the electrode rod small-diameter portion has a diameter of 0.4 mm, for example, the quartz glass body 6 has an inner diameter of 0.45 mm for example, the total length of the quartz glass body 6 is 1.5 mm, and the outer diameter thereof is 1.8 mm.

Although the quartz glass body 6 and the hermetically sealed portion 3 are clearly distinguished in the above figure, they are actually welded by heating up of the quartz glass, which is the same material, so the quartz glass body 6 and the sealed portion 3 are nearly formed into a single body. The boundary between the outer surface of the quartz glass body 6 and the sealed portion 3 cannot be distinguished visually, but the existence of a fabrication line for the quartz glass body 6 can be visually distinguished on the edge facing the discharge space of the quartz glass body 6, the existence of the infrared reflecting membrane 8 can be visually distinguished on the inside surface of the quartz glass body 6, and the existence of color difference portions can be distinguished by EPMA analysis. It can thereby be confirmed that the electrode rod 5 is passed through the central hole of the quartz glass body 6 having the infrared reflecting membrane 8 composed of a heat-resistant metal on the inner surface of the central hole, then is sealed.

FIGS. 3(*a*)-(*f*) show the steps an example of a method of manufacturing the electrode mount of the present invention.

First, as shown in FIG. 3(*a*), the coil 9 for fastening the quartz glass body to the small-diameter portion of the metal foil 7 where the electrode rod passes through is prepared. Next, as shown in FIG. 3(*b*), a quartz glass body 6 which is coated by the infrared reflecting membrane 8 on the inner surface of the central hole and which is to be passed through by the small-diameter portion 52 of the electrode rod 5 is prepared. As shown in FIG. 3(*c*), the small-diameter portion 52 of the electrode rod 5 is inserted into the quartz glass body 6 until the quartz glass body 6 comes into contact with the electrode rod step portion 53. As shown in FIG. 3(*d*), the small-diameter portion of the metal foil 7 overlaps the electrode small-diameter portion 52 of the electrode rod 5. As shown in FIG. 3(*e*), the coil 9 on the small-diameter portion of the metal foil 7 is slid until contact is made with the quartz glass body 6. As a result, the quartz glass body 6 is positioned between the electrode rod step portion 53 and the coil 9. As shown in FIG. 3(*f*), the small-diameter portion 52 and the metal foil 7 are welded together, and the coil 9 is also welded and fastened to the electrode rod small-diameter portion 52.

As a result, the small-diameter portion 52 of the electrode rod and the infrared reflecting membrane 8 on the inner surface of the central hole in the quartz glass body 6 are separated along the entire length of the quartz glass body 6, and the small-diameter portion 52 of the electrode rod 5 and quartz glass body 6 can be structured so as not to be welded together.

A structure such as the above is believed to result for the following reasons. When the electrode 4 and electrode rod 5 become red hot when a burner is put into contact with the outer surface of the hermetically sealed portion 3 and heated up during the lamp sealing process, infrared rays are radiated from the red-hot electrode rod 5 toward the inner surface of the body 6 bounding the central hole in the quartz glass body 6. By having the infrared reflecting membrane 8, composed from a heat-resistant metal, cover the inside surface of the central hole in the quartz glass body 6, it is believed that, due to the existence of the infrared reflecting membrane 8, the infrared rays are reflected back toward the electrode rod 5, thereby preventing the inner surface of the quartz glass body 6 from melting and making possible a structure wherein the electrode rod 5 and the infrared reflecting membrane 8 on the inner surface of the quartz glass body 6 remain separated and enables the electrode rod 5 and the quartz glass body 6 to be not welded together.

It is further believed that the conductive heat from the outer surface of the hermetically sealed portion 3 heated by the burner reaches the inside surface of the central hole in the quartz glass body 6, but the molybdenum (Mo) in the infrared reflecting membrane 8 has a higher thermal emission than the quartz glass, so the heat is released to the internal cylinder space, the temperature of the inner surface of the central hole in the quartz glass body 6 does not increase to the temperature at which the quartz glass contracts. Therefore, the electrode rod 5 and the infrared reflecting membrane 8 in the central hole of the quartz glass body 6 are separated, resulting in a structure wherein the electrode rod 5 and the quartz glass body 6 are not welded together.

Following is an explanation of an experiment wherein the presence or absence of warping in the electrode rod portion when a lamp is repeatedly lit and unlit was studied using a high pressure discharge lamp employing the electrode mount relating to the present invention and a high pressure discharge lamp relating to the prior art.

For the experiment explained below, 30 lamps of each of 4 types of high pressure discharge lamps (Embodiment 1 relating to the present invention, Comparative Example 1, Comparative Example 2, Comparative Example 3) with an alternating current rating power of 275 W and having a structure near the electrode rods according to the following embodiment were prepared.

A high pressure discharge lamp in Embodiment 1 relating to the present invention is structured near the electrode rods such that an electrode mount like that shown in FIG. 2 exists, a Mo membrane is sputter deposited onto the inner surface of the central hole in a quartz glass body 6 as an infrared reflecting membrane 8, and an electrode rod 5 does not directly come into contact with the central hole of the quartz glass body 6. The film thickness of the above-mentioned sputtering is within the range from 1 to 5 μm.

The high pressure discharge lamp in Comparative Example 1 has a structure near the electrode rods wherein the quartz glass in the sealed portion surrounding the electrode rods was melted and made to contract in a negative pressure environment, and cracks visible with the naked eye already existed in the glass portions of the hermetically sealed portions which were in contact with the electrode rods before usage of the lamp started.

The high pressure discharge lamp in Comparative Example 2 has a structure near the electrode rods wherein the quartz glass in the sealed portion surrounding the electrode rods was melted and made to contract in a negative pressure environment, and no cracks visible with the naked eye existed in the glass portion of the hermetically sealed portions which were in contact with the electrode rods before usage of the lamp started.

The high pressure discharge lamp in Comparative Example 3 is a quartz glass body similar to the quartz glass body in Embodiment 1 relating to the present invention, but in a state where electrode rods are passed through the central hole in the quartz glass body which does not have any infrared reflecting membrane on the inner surface thereof, the high pressure discharge lamp has a structure near the electrode rods wherein the glass in the surrounding hermetically sealed portion is melted and made to contract in a negative pressure environment, and no cracks visible to the naked eye existed in the glass portion of the hermetically sealed portions which is in contact with the electrode rods before lamp usage started.

Figures 4, 5:
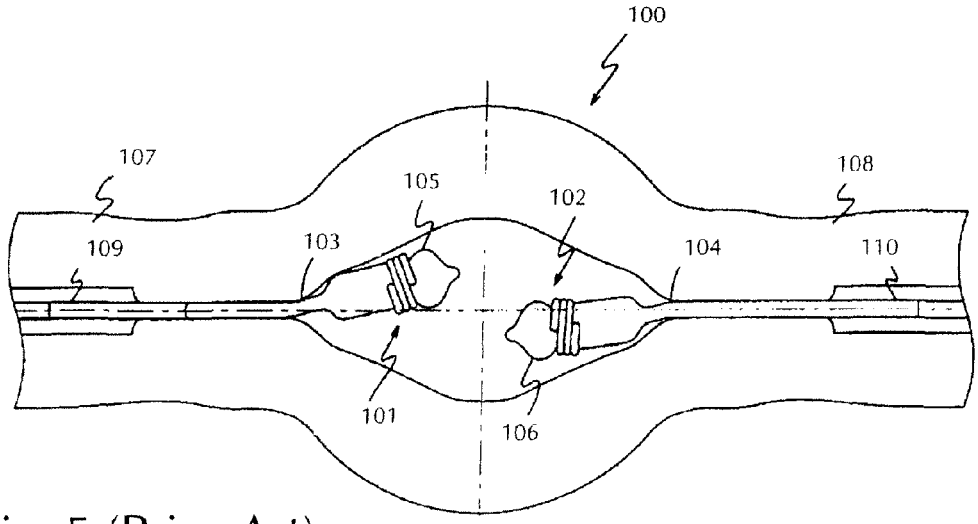
Fig. 5 (Prior Art)
FIG. 4 is a table summarizing experiment results.
FIG. 5 is a partial frontal view of the structure of the high pressure discharge lamp according to the prior art in which electrode rod warping has occurred.

In the experiment, 30 lamps of each of 4 types (Embodiment 1 relating to the present invention, Comparative Example 1, Comparative Example 2, Comparative Example 3) of high pressure discharge lamps with rated power of 275 W when lit using alternating current were lit and unlit up to 1,000 times under conditions where the lamps were lit for 3 minutes then unlit for 3 minutes. The table in FIG. 4 summarizes the results of the experiment. In the results, warping was judged to have occurred if warping occurred in even just one of the electrode rods. In the table, an absence of warping is represented by an "o" and the occurrence of warping by an "x".

According to the judgment criteria for electrode rod warping, warping was judged to have occurred in an electrode rod if the separation distance between the center positions of the electrode heads relative to the longitudinal axis of the electrode rods reached 1.0 mm or more in a high pressure discharge lamp wherein the distance from the electrode head center position to the opening in the quartz glass is 5 mm.

As shown in FIG. 4, the electrode rod warping phenomenon did not occur in the high pressure discharge lamps in Embodiment 1 relating to the present invention even when the lit/unlit cycle was repeated 1,000 times. In Comparative Example 1 however, electrode rod warping occurred after only 20 lit/unlit cycles. In Comparative Example 2, electrode rod warping occurred after 120 lit/unlit cycles. In Comparative Example 3, electrode rod warping occurred after 100 lit/unlit cycles. As is clear from these results, high pressure discharge lamps having an electrode mount according to the present invention are very effective in preventing electrode rod warping from occurring.

What is claimed is:

1. A high pressure discharge lamp, comprising:

an arc tube composed of quartz glass with a hermetically sealed portion on each of opposite sides of the arc tube, a quartz glass body being located in each sealed portion, and a pair of opposed electrodes supported on electrode rods inside of said arc tube;

wherein each of the electrode rods pass through a center hole in a respective quartz glass body, wherein a gap is provided between an inner surface of the quartz glass body bounding the center hole and the respective electrode rod, said quartz glass body being fastened onto said electrode rod, wherein an infrared reflection membrane made of a heat-resistant metal is provided on said inner surface of the quartz glass body, and wherein said quartz glass body is integrated with the quartz glass of said hermetically sealed portion.

2. The high pressure discharge lamp according to claim 1, wherein said electrode rods comprise a large-diameter portion extending from said electrodes and a small-diameter portion extending from the large-diameter portion with a step portion being formed at the boundary between the large-diameter portion and the small-diameter portion, wherein the small-diameter portion passes through the center hole in said quartz glass body, wherein said quartz glass body is positioned against the step portion, and wherein an end face of said quartz glass body that faces toward the respective electrode has a concave shape which is symmetrical along the central axis of the quartz glass body with the diameter of said end face gradually increasing in a radially outward direction.

3. The high pressure discharge lamp according to claim 2, wherein said infrared reflection membrane is made of molybdenum.

4. The high pressure discharge lamp according to claim 3, wherein the arc tube contains 0.16 $mg/mm^3$ of mercury, a noble gas, and a halogen and is constructed for being lit up by an alternating current.

5. The high pressure discharge lamp according to claim 1, wherein said infrared reflection membrane is made of molybdenum.

6. The high pressure discharge lamp according to claim 5, wherein the arc tube contains 0.16 $mg/mm^3$ of mercury, a noble gas, and a halogen and is constructed for being lit up by an alternating current.

7. The high pressure discharge lamp according to claim 1, wherein said quartz glass body is fastened onto said electrode rod by a coil being slid onto the electrode rod until contact is made with the quartz glass body so as to position the quartz glass body between the electrode rod step portion and the coil.

8. The high pressure discharge lamp according to claim 7, wherein the coil is welded and fastened to the electrode rod small-diameter portion.

* * * * *